United States Patent [19]

Willach

[11] 4,149,212

[45] Apr. 10, 1979

[54] ELECTRICALLY ENCODED, ELECTRICALLY CONTROLLED PUSH-BUTTON COMBINATION LOCK

[75] Inventor: Rolf Willach, Au, Switzerland

[73] Assignee: Huwil-Werke GmbH, Möbelschloss- und Beschlagfabriken, Ruppichteroth, Fed. Rep. of Germany

[21] Appl. No.: 864,743

[22] Filed: Dec. 27, 1977

[30] Foreign Application Priority Data

Sep. 12, 1977 [CH] Switzerland ..... 011117/77

[51] Int. Cl.[2] ..... E05B 49/00

[52] U.S. Cl. ..... 361/172; 70/278; 340/147 MD; 340/164 R

[58] Field of Search ..... 361/172; 340/147 MB, 340/164 R; 70/278; 307/10 AT

[56] References Cited

U.S. PATENT DOCUMENTS

| | | | |
|---|---|---|---|
| 3,633,167 | 1/1972 | Hedin | 70/278 X |
| 3,751,718 | 8/1973 | Hanchett | 361/172 |
| 3,766,522 | 10/1973 | Marsh | 361/172 X |
| 4,050,063 | 9/1977 | Schull | 340/147 MD |

OTHER PUBLICATIONS

Platteter, Dale; "Digital Combination Lock is Virtually Crackproof", Nov. 11, 1976; Electronics, pp. 100–101.

*Primary Examiner*—J D Miller
*Assistant Examiner*—L. Schroeder
*Attorney, Agent, or Firm*—Flynn & Frishauf

[57] ABSTRACT

An encoding circuit is provided permitting energization of an electromagnetic unlocking solenoid if a series of push-button switches is operated in accordance with a predetermined code. The circuit includes a memory which stores the sequence of operation of the push-buttons in accordance with the code in form of a binary code word. A comparison or decision stage is connected to the memory, typically a shift register, and connected to the memory position of all the digits of the code associated with the specific lock of a binary 1 value, as well as all the digits of the code in a binary 0 value, the decision circuit controlling the unlocking solenoid only if both the binary 1 and binary 0 values stored in the memory upon sequential push-button operation conform to the code associated with the lock, and, simultaneously, a timing circuit energized upon initiation of the first properly coded push-button still provides a timing energization signal, or operating energy to the circuit. In addition, the decision stage includes another input connected to a memory position, the value of which is unaffected by operation of the push-button switches so that additional safety against opening of the lock by trial-and-error operation of the push-buttons is provided.

13 Claims, 3 Drawing Figures

ELECTRICALLY ENCODED, ELECTRICALLY CONTROLLED PUSH-BUTTON COMBINATION LOCK

Cross reference to related application, the disclosure of which is incorporated herein by reference: U.S. Ser. No. 864,742, filed Dec. 27, 1977, Horst WILLACH.

The present invention relates to a push-button combination lock having electronic coding, and more specifically to an electronic coding circuit which controls opening of the lock if a proper code is entered by operation of a multiple number of push-buttons in a predetermined sequence.

BACKGROUND OF THE INVENTION

Push-button-operated coding systems are known, for example the encoding of telephone numbers by push-button phones. Copending, cross-referenced and herein incorporated application Ser. No. 864,742, filed Dec. 27, 1978, Horst WILLACH in which the coding circuit is so arranged that single or multiple operation of selected ones of a group of a push-buttons provides pulses, associated with the respective value or digital position assigned to a specific push-button and which is, in turn, associated with the respective value or digital position assigned to a specific push-button and which is, in turn, associated with a certain position of a combination. The circuit additionally is connected to a source of energy which provides electrical energy to permit an opening operation of the lock to be carried out, for example by pullin-in a magnet which otherwise blocks or prevents opening operation of the lock, for instance by a knob. The energy source is time-limited to provide electrical energy only for a predetermined time interval or, rather, for a predetermined amount of energy, which is charged upon operation of the first push-button in accordance with the coded combination. After a predetermined time interval, as determined by the time element, the coded circuit is deenergized, resulting in automatic locking of the locking mechanism.

The timing circuit and energy supply circuit in accordance with a feature of the cross-referenced application in its simplest form is a capacitor which is charged from a source of electrical energy, the charge on the capacitor then supplying the necessary electrical energy for both the decoding of the push-button operation and for initiating permission of the unlocking of the lock, for example by pulling in a magnet for a predetermined and limited time interval.

PRIOR ART

Coded control circuits for push-button combination locks, also known as electrical locking devices, have previously been proposed. Some circuits, as previously proposed, use relays which have the disadvantages of relay circuitry in that they require a substantial space, inhibiting installation of such a circuit with relays in a small lock, or rendering it rather difficult; further, the current requirements are high. Relays, further, always are in danger of malfunction due to dirty contacts, which can be avoided only by expensive sealed relays, or otherwise expensive alternatives which go beyond those normally associated with the price of a lock.

Electronic circuits, as known, have the disadvantage that, if the circuitry itself is comparatively simple, only a limited number of permitted codes is possible so that the probability of unauthorized opening by trial and error is not negligible. Increasing the coding possibilities by increasing the logic contents within the circuitry requires substantial additional circuits, thus substantially increasing the costs and potential for trouble within the coding circuits.

THE INVENTION

It is an object to provide a push-button combination lock having a coding circuit in which only a limited number of push-buttons are used, which is highly reliable, and is essentially immune to unauthorized operation, and opening by repetitive trial of combinations.

Briefly, at least one memory is included in the coding circuit which can receive a code entered upon operation of push-buttons, in accordance with a binary code. A decision circuit or decoding circuit is connected to the memory, the decoding or decision circuit having inputs associated with the code elements of one binary value, for all the code elements corresponding to a predetermined code associated with the lock, as well as for the other binary value associated with said code and one input for a predetermined code element, the binary value of which does not change during the input of the code numbers into the memory. The output of the decision or decoding circuit then is connected to permit opening of the lock if, and only if, both of the binary values — typically a 1-signal and a 0-signal match the code with which the lock is associated.

Drawings, illustrating an example:

Figure 3:
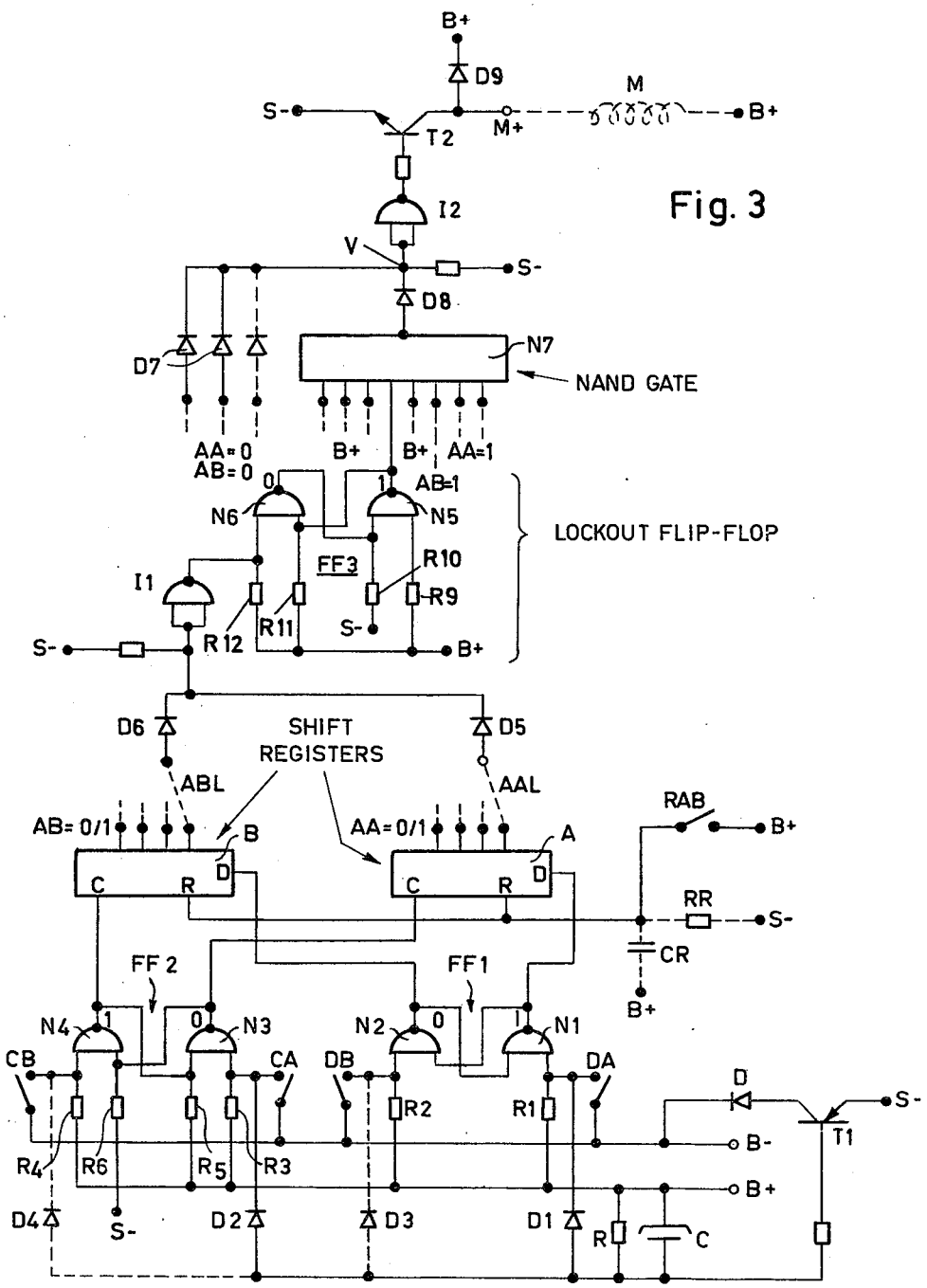

and FIG. 3 is a schematic diagram of the coding circuit.

Figure 2:
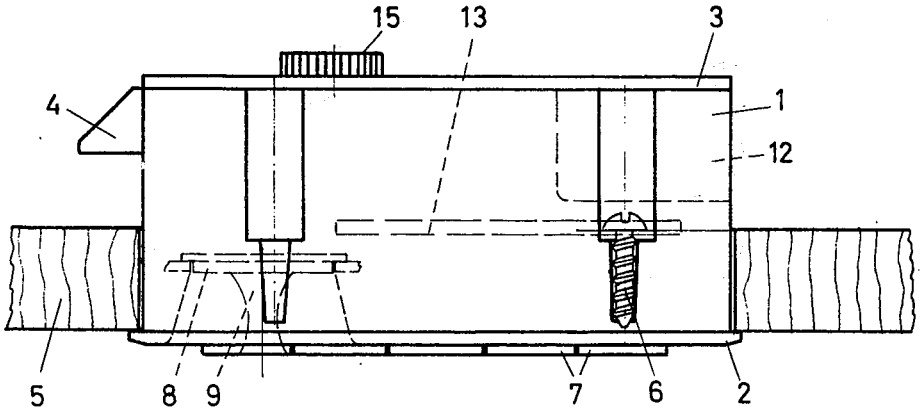
FIG. 2 is a schematic top view of a lock installed in a wooden door, for example the door of an item of furniture.

A box-shaped housing 1 has a front plate 2, a back side 3, and a movable locking bolt 4. The lock is located in a wooden door 5 (FIG. 2), for example the door of an item of furniture, a file, a locker cabinet, or the like, being inserted through a suitable opening in the door, so that the front plate 2 fits against the door 5, the lock being secured to the door by means of screws 6.

Five push-buttons 7, for example of square shape, are located in the front plate 2 of the lock. These push-buttons must be operated in the proper sequence, and for the proper number of times, in order to permit unlocking of the bolt 4. The bolt 4, itself, is operated by a twist knob or handle 8, recessed in the front plate 1 and within the housing 1. The handle is formed with a hand-gripping portion 9, so shaped that it can be rotated by the fingers of the user and capable of being coupled to the bolt 4 if the proper combination has been entered in the push-button 7. Additionally, the knob 8 can be used to pull out the door 5, upon opening movement, if the lock has been unlocked.

Figure 1:
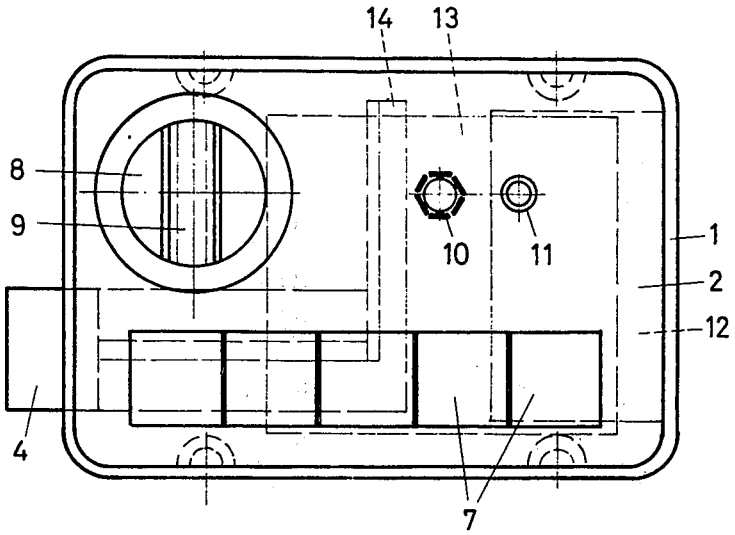
FIG. 1 is a schematic front view of a lock in accordance with the present invention.

The front plate 1 additionally is formed with two terminals 10, 11 which are formed as button contacts to receive matching contacts of a standard 9V battery. This connection is an emergency current supply to operate the lock if a similar battery 12, located within the interior of the housing 1, should have failed. Battery 12 is shown in broken lines in FIGS. 1 and 2 and supplies the electronic coding circuit which is located on a printed circuit board 13, and additionally provides power for an electrically operated locking mechanism 14 which includes an electromagnet. If the electromagnet is energized, the bolt 4 can be operated by moving the knob 8.

An override button 15 (FIG. 2) is provided at the interior or rear of the lock to hold the bolt 4 in continued unlocked position so that the lock can be opened merely by rotation of the knob 8 without repeated encoding of the code, for example during working hours when access to the contents within the furniture element 5 is to be obtained repeatedly.

The details of the construction of the lock are described and shown in the aforementioned cross-referenced copending application, the disclosure of which is incorporated herein by reference.

FIG. 3 shows the circuit which controls the unlocking or locking operation of mechanism 14. In the example, five push-buttons are used which must be operated in a predetermined sequence. In the example, the encoded number provides a combination of eight binary code words, selected to be 1010 and 0100. These are the code numbers associated with the lock, selected for the illustration. The circuit diagram additionally shows external connections from the circuit as open circles, internal connection being shown as full circles.

The external connections of the circuit are three: Two battery terminals B+ and B−, and corresponding to connections to battery 12 (FIG. 1) and the external emergency terminals 10, 11. Another terminal is terminal M+ which is connected to a solenoid coil M forming part of the unlocking mechanism 14 (FIG. 1) which, when energized, pulls in an unlocking armature lever which then permits operation of knob 8 or engagement of knob 8 with the bolt 4. Of course, coil N, which is internally connected to a B+ terminal, can be be energized only if the proper code combination has been entered into the push-buttons.

The five external push-buttons are shown as switches RAB, DA, DB, CA and CB. The first one of these buttons to be operated controls application of energy to an energy storage element which provides a limited amount of energy, or energy for a limited period of time. Unless this button is first operated, the other buttons are never energized.

The first button to be operated is button DA. It is connected to negative terminal B−, that is, to the negative terminal of battery 12, and through a diode D1 to a terminal B+, that is, to the positive terminal of the battery, through an R/C circuit having a capacitor C, in parallel connection to a resistor R. The R/C circuit is additionally connected through a coupling resistor to the base of a transistor T1 which forms a battery connection or battery switch for the negative battery supply within the circuit. The collector of transistor T1 is connected through a diode D with the terminal B−; its emitter is connected to a main power supply bus S−, and forming the negative battery supply bus for the system.

Operation of power supply initiation: When the button DA is pressed, the switch will close and capacitor C is immediately charged over diode D1. The negative capacitor voltage opens the pnp transistor T1, so that the terminal S− will have a negative voltage appear thereon until the capacitor C has almost entirely discharged through the resistor R, then causing blocking of transistor T1. All further terminals connected to this battery switch within the system have been denoted S−. The unswitched connections are connected to B+.

Two flip-flops FF1 and FF2, as well as two shift registers A and B, each with a storage capacity of four bits, are provided in order to insert the pulses caused by operation of the buttons RAB, DA, DB, CA and CB. Each flip-flop (FF) is formed of two cross-coupled NAND-gates N1 and N2 and, respectively, N3 and N4. One of the two inputs of the respective NAND-gates are connected to a respective one of the push-buttons DA, DB, CA, CB. The other input is connected to the output of the other NAND-gate of the same FF. The inputs connected to the buttons DA, DB, CA, CB of the NAND-gates N1 to N4 are connected over respective resistors R1, R2, R3, R4 with the B+ terminal of the battery, as well known.

The second inputs to the NAND-gates N4, N3 are connected over resistors R6, R5, resepectively, to terminals S− and B+, respectively, in order to prevent a random position of FF2 upon first tracing negative battery voltage to the terminal B−, that is, after first operating the button DA. Thus, after operation of the button DA, the NAND-gate N3 will always have an output binary value 0 and, correspondingly, the NAND-gate N4 will have an output binary value of 1, as shown in FIG. 3.

The dashed connection through diodes D3, D4 can be provided instead of the connections over the diodes D1, D2 if the button DB should be the button which is first operated, rather than the button DA, as assumed in the example, and the button CB is to be last operated, rather than the button CA as assumed in the example.

The example CA is connected over the diode D2 to the capacitor C to charge the capacitor, similar to the connection of the button DA through the diode D1. In the example selected, the button CA is the last-to-be-operated button and recharges the capacitor C to energize the electrically operated locking mechanism, that is, to permit connection of operating energy for the magnet M.

The two shift registers A and B each have a data input D, a clock or shift input C and a reset input R. In the example selected, they are of 4-bit capacity, and have four outputs AA and AB. The data inputs D are connected with the outputs of the NAND-gates N1 and N2, respectively, of the FF1. The shift inputs C are connected to the outputs NAND-gates N3 and N4 of FF2, respectively, as shown. The reset inputs R are commonly connected to operating button RAB which is connected to the positive terminal of the battery voltage B+. The connection of the outputs AA, AB of the shift registers A and B will be explained below.

Operation, upon sequential operation of the push-buttons: In the example selected, the buttons DA, DB, CA, CB and RAB are assumed to enter the code numbers 1010 and 0100 so that at the output of the shift register A, the word 1010 will appear; and at the output of the shift B the word 0100 will appear.

1. Operation of button DA. This provides negative battery voltage through transistor T1 to all the terminals S−. The data input D of shift register A will have binary 1, since N1 is clamped to B+.

2. Button RAB is pressed. This applies positive battery voltage to the reset inputs R of both shift registers A and B, so that their outputs AA and AB each will have the number 0000 thereon.

3. Button CA is pressed. This changes over FF2, and NAND-gate N3, and hence clock input C of shift register A will have a binary 11, shifting shift register A by one stage. Since D of shift register A is a 1, L shift register A will now have the number 1000 appear therein. The output of shift register B, as before, will remain at 0000.

4. Operation of button DB. This changes over FF1, the output of NAND-gate N2 will provide a binary 1 to the data input D of shift register B, and the data input D of shift register A will have a 0 appear thereon.

5. Operation of button CB. This again changes state of FF2. The output of NAND-gate N4, and hence the clock input C of shift register B will now have a binary 1 (as in the original position). The data input D still has a binary 1 applied, thus, shift register B is shifted one position so that the output AB will now indicate AB = 1000 and, as previously, shift register A has on its output AA also 1000.

6. Button CA is operated (the second time). FF2 again changes state, the output of NAND-gate N3, and thus the clock input C of register A has a binary 1, so that the binary 0 on data input D is shifted into the register A. Thus, shift register A will register: AA = 0100; shift register B will register, as before, AB = 1000.

7. Operation of button DA. This changes over FF1, the output of NAND-gate N1, and hence the data input D of shift register A has the binary value 1.

8. Button CB is operated, changing FF2, the output of NAND-gate N4, and thus clock input of shift register B has binary 1, so that the data input value 0 at data input D is entered into the shift register B. As a result, outputs of the shift register A as before, AA = 1000; shift register B, output AB = 0100.

9. CA is operated, as the last button. This changes over FF2, so that NAND-gate N3 and thus clock input C of register A has a binary 1. The binary 1 at the data input is entered in shift register A. Thus, the output of the shift register A has the code elements AA = 1010; the output of the shift register B will have the code word AB = 0100 therein, as before.

Simultaneously with the operation of the last button CA, diode D2 provides for recharging of capacitor C so that, upon checking or comparison of the code inserted into the shift registers and appearing at the outputs thereof, sufficient electrical energy is provided to energize the electrically operated unlocking control element, typically magnet M, provided the code was correct.

Entering the code can be simplified by omitting the reset push-button RAB, so that then only four buttons DA, DB, CA, CB are used. In order to provide for resetting of the shift registers A and B before the first clock pulse is applied, a dynamic coupling R/C element is connected to the S− connection from transistor T1 and the positive supply voltage B+ in parallel or in lieu of the button RAB. Resistors RR and capacitor CR are connected as shown, to effect resetting by a pulse, when transistor T1 first becomes conductive. This circuit is preferably provided within the circuit structure so that it can be universally applied for a four-button as well as for a five-button lock. If the switch RAB is omitted, initial operation of the button DA and subsequent appearance of negative battery voltage at the terminal S− provides a positive pulse on capacitor CR which resets the shift registers A and B by energization of the terminals R, so that the shift registers will have the numbers 0000 therein. The time constant of the C/R circuit formed by capacitor CR and resistor RR is so selected that the voltage at the reset terminal R drops to the voltage level of the terminal S−, that is, to negative battery voltage, so that resetting cannot be repeated. If switch RAB is omitted, then the second above referred-to step is likewise omitted.

The code entered into the shift registers A and B, after eight (or nine if button RAB is present) operations is compared or checked with the code assigned to the lock.

The comparison or decision circuit comprises a NAND-circuit N7 having eight inputs, and a group of parallel connected diodes D7, as well as lock-out FF3. The junction of the diodes D7 and the output of the NAND-gate N7, through a further diode D8, is connected over an inverter I2 and through a limiting resistor to the base of an npn transistor T2, the emitter of which is connected to the controlled supply bus S−. The collector is connected to the terminal M+ for connection to a magnet coil of the unlocking unit 14 (FIG. 1) and then to a positive terminal B+. Diode D9 protects transistor T2 and is a free-wheeling or anti-kickback diode, in parallel to the coil M of the electromagnetic unloading unit 14. Transistor T2 is conductive if its base has a binary 1 applied thereto, that is, if the junction V ahead of the inverter I2 has a binary 0. This is only possible if all the diodes D7 as well as the output of the NAND-circuit N7 have a binary 0.

Diodes D7 check if the binary value 0, within the shift registers as set therein and stored in the proper sequence, are at the proper positions. Thus, they are connected corresponding to the code 1010 to the second and fourth outputs of the shift register A and, in accordance with the code 0100, to the first, third and fourth outputs of the shift register B. Each one of these outputs will have a diode D7 connected to terminal V. This is schematically shown in the drawing by the notation AA = 0 and AB = 0 to the diode connections, only three of which are shown to simplify the drawing although, for the selected code, five would be needed.

Those outputs of the shift registers A and B which have a binary 1, in accordance with the code, that is, the first and the third outputs of the shift register A, and the second output of shift register B, are each connected to an input of the NAND-circuit N7, which is schematically indicated in FIG. 3 by the notation AA = 1 and AB = 1. The other inputs are not needed in the present circuit; they are provided if other codes are used having more than three binary 1 values, and, in the example shown, are therefore connected to the B+ bus, except for one further input which is connected to the output of the lockout FF3.

The lockout FF3 has two cross-coupled NAND-gates N5, N6, the inputs of which are connected over resistors R9, R10 and R11, R12 with the positive battery terminal B+ and with the controlled negative terminal S− in such a manner that operation of the first button DA and subsequent switching of the transistor T1 provides a binary 1 at the output of NAND-gate N5 and correspondingly a binary 0 at the output of NAND-gate N6, as illustrated in the drawing. The output of NAND-gate N5 is connected to the respective input of the NAND-gate N7. The input of NAND-gate N6 which is connected over resistor R12 with the positive terminal B+ is additionally connected over an inverter I1 and diodes D5, D6 with specific output terminals AAL and ABL of the shift registers A, B. These outputs are those terminals from the shift register A, B, respectively, which follow the last output which had a binary 1 thereon. Thus, for the shift register A, with the code 101$\underline{0}$, it is the last one, that is, that digit corresponding to the last, underlined position. For the B register, which stores the code 01$\underline{0}$0, it is the third output corresponding to the underlined position. These shift register outputs have the characteristic that the binary value thereon of 0 does not change if the sequence of operation of the push-buttons was correct. If, however, due to incorrect operation of the push-buttons, and particularly if someone were to try to decode the system by trial and error, one of these shift register locations ever has a binary 1, the inverter I1 will apply a binary 0 to the input of the NAND-gate N6, causing FF3 to change state so that the output of NAND-GATE N6 will have a binary 1. The corresponding input of NAND-gate N7 will then have a binary 0 thereat which, after inversion in inverter I2, blocks transistor T2. The output of NAND-gate N6 does not change if inverter I1 again applies a binary 1 to the input of NAND-gate N6, FF3 will not flip back so that transistor T2 continues to remain blocked, even if, due to further trial-and-error operation of the push-buttons, the outputs of the shift registers A and B later on have the correct code elements appear thereon. First, capacitor C has to discharge, blocking transistor T1, before a new code can be entered into the system.

The transistor T2 will be placed into conductive state, permitting unlocking of the locking bolt if, and only if, the coded entered binary values correspond to the code of the specific lock or, in other words, with the code connected in, wired in or programmed into the lock and if, additionally, the binary values entered into the code buttons have the proper number of button operations in the proper sequence.

The coding circuit provides high reliability against unauthorized opening of the lock by means of trial and error while still requiring only a minimum of circuit components. Additionally, it permits a large number of different coding numbers. In the example selected, and using two 4-bit shift registers, or one 8-bit shift register, and five push-buttons — which can be permutated — the theoretically possible number of different code combinations is 30,720. If the lockout feature is to be used, namely supervision of the number following the last binary 1 to check that it will be a binary 0, a slightly lower number of possible code combinations will result.

The code control circuit can be constructed as an integrated circuit. It does not require network power connections and is particularly suitable for furniture and office furniture locks, for example as locks in files, lockers, for desks, and the like.

Various changes and modifications may be made. For example, a single shift register rather than two shift registers A, B can be used, although two shift registers may be less expensive. Different word lengths can be used, and pulses to enter shift pulses generated by push-button operation can be generated automatically by a separate clock source so that the coded push-button operations are shifted under command of the clock source, rather than by maual push button operation. The specific coding of a lock can be changed by changing the connections of the outputs of the shift register. The shift register outputs can be brought out to patch-board terminals, or plug board or wire bridge connections, or to encoding switches to permit subsequent change of the code to which the lock will respond, or to readily provide precoding of a number of locks to the same code, and subsequent change, if desired.

Various other changes and modifications may be made within the scope of the inventive concept.

I claim:

1. Electrically encoded, electrically controlled push-button conbination lock comprising electromagnetically controlled locking means (4,14) normally in locked condition;

a plurality of push-button switches (7, DA, CB, CA, CB, RAB);

an encoding circuit (13) connected to the push-button switches providing an output permitting unlocking of the locking means if, and only if, the sequence of operation of the plurality of push-button switches conforms to a code contained in the encoding circuit comprising, in accordance with the invention, a memory (A, B) connected to said push-button switches and storing, in binary form, the sequence of operation of the respective push-button switches in the form of a binary code word;

a comparison or decision stage (N7, D7) connected to said memory (A, B) and having first input means (AA = 1; AB = 1) connected to the memory at the memory positions of all digits of the code associated with the specific lock of one binary digital value (1);

second input means (AA ; 0; AB = 0) connected to the memory at the memory positions of all digits associated with the specific lock of the code word of the other binary digital value (0);

and third input means connected to the memory at a memory position, the value of which is unaffected by operation of the push-button switches if the push-button switches are operated in accordance with the code associated with said lock;

and means (I2, T2, M) connected to control the locking means (4, 14) in accordance with the decision of the decision and comparison means (a) if the code entered by operation of the push-button switches into the memory conforms to the code associated with the specific lock, as determined by the connections between said first, second and third input means and the memory, to control the locking means to permit unlocking thereof; or (b) if the code entered by operation of the push-button switches into the memory does not conform to the code associated with the specific lock, as determined by the connection between said first, second and third input means and the memory, to control the locking means (4, 14) to remain in disabled or de-energized condition and hence inhibit unlocking operation of the lock.

2. Lock according to claim 1, wherein the comparison or decision stage (N7, D7) comprises a first AND-function circuit (N7) and a second AND-function circuit (D7), the outputs of said first and second AND-function circuits being connected to the locking control means (I2, T2, M), said first and second AND-function gates having said respective first and second input means connected as inputs thereto;

and therein a lockout circuit (FF3) is provided, connected to one (N7) of said AND-function circuits through said third input means, the lockout circuit being connected to a memory position of the memory (A, B) in which the binary value does not change if the proper code is entered into the memory by the push-button switches.

3. Lock according to claim 2, wherein the lockout circuit comprises a flip-flop (FF3), the reset of which is connected to a fixed source of power at a predetermined binary value (B+).

4. Lock according to claim 1, wherein the memory (A, B) comprises at least one shift register, the register positions of which are connected to respective input means of the comparison or decision stage (N7, D7).

5. Lock according to claim 1, further including trigger circuit means (RR, CR) connected to clear the memory (A, B) upon operation of the first push-button switch which, in accordance with the code word associated with a specific lock, enters encoded representation of the sequence of operations of the respective push-button switches in the memory.

6. Lock according to claim 1, further comprising a timing circuit (R, C, T1);

a source of operating power (12, B+, B−), the timing circuit being connected to said source of operating power (12) and to one of the push-button switches (DA) which, in accordance with the code, is the first one to be operated, to start a timing interval;

said timing circuit controlling energization of the encoding circuit (13) to permit entry of said code word into the memory (A, B) of said encoding circuit upon subsequent operation of the push-button switches, said timing circuit, after elapse of said timing interval, de-energizing said encoding circuit.

7. Lock according to claim 6, wherein the timing circuit includes a charge capacitor (C);

and first connection means from said first one push-button which is to be operated, in accordance with the code, to said capacitor to establish a current path therethrough and charge the capacitor from said source (12).

8. Lock according to claim 7, further comprising second connection means from the last one of the push-button switches to be operated, in accordance with the code, to said capacitor (C) to establish a current path therethrough and recharge the capacitor from said source (12) to re-establish said timing interval;

and power supply connection means (S−) to said locking control means (4, 14) for energization thereof by said source, under control of said timing circuit only during said time interval if the comparison or decision stage (N7, D7) of the encoding circuit (13) has decoded the operation of the push-buttons to conform to the code associated with the specific lock.

9. Lock according to claim 7, further including trigger circuit means (RR, CR) connected to clear the memory (A, B) upon operation of the first push-button which, in accordance with the code word associated with a specific lock, enters encoded representation of the sequence of operations of the respective push-buttons in the memory.

10. Lock according to claim 6, including trigger circuit means (CR, RR) connected to the memory (A, B) to clear the memory, said trigger circuit means being interconnected with said timing circuit to reset the memory upon release of said one of the push-buttons (DA) which, in accordance with the code, is the first one to be operated.

11. Lock according to claim 1, wherein said push-button switches (7) include one switch connected to the memory (A, B) to clear the memory, said push-button switch (RAB) being assigned the second button operation sequence of the code word associated with the lock.

12. Lock according to claim 7, including trigger circuit means (CR, RR) connected to the memory (A, B) to clear the memory, said trigger circuit means being interconnected with said timing circuit to reset the memory upon release of said one of the push-buttons (DA) which, in accordance with the code, is the first one to be operated.

13. Lock according to claim 1, wherein said push-button switches (7) include one switch connected to the memory (A, B) to clear the memory, said push-button switch (RAB) being assigned the second button operation sequence of the code word associated with the lock.

* * * * *

UNITED STATES PATENT AND TRADEMARK OFFICE

CERTIFICATE OF CORRECTION

PATENT NO. : 4,149,212

DATED : April 10, 1979

INVENTOR(S) : Rolf WILLACH

It is certified that error appears in the above-identified patent and that said Letters Patent are hereby corrected as shown below:

Column 1, line 24, change "December 27, 1978" to - December 27, 1977 --

Signed and Sealed this

*Seventeenth* Day of *July 1979*

[SEAL]

*Attest:*

*Attesting Officer*

LUTRELLE F. PARKER

*Acting Commissioner of Patents and Trademarks*